United States Patent [19]

Bechtold

[11] 4,079,679

[45] Mar. 21, 1978

[54] SELF LOCKING FOLDING LEG

[76] Inventor: Edwin Bechtold, R.R. 5, Minot, N. Dak. 58701

[21] Appl. No.: 743,311

[22] Filed: Nov. 19, 1976

[51] Int. Cl.[2] ..... A47B 3/00

[52] U.S. Cl. ..... 108/132; 248/439

[58] Field of Search ..... 108/129, 131–133; 248/188.6, 439

[56] References Cited

U.S. PATENT DOCUMENTS

| | | | |
|---|---|---|---|
| 538,748 | 5/1895 | Schroder et al. | 108/131 X |
| 2,318,945 | 5/1943 | Johannsen | 108/133 |
| 2,432,266 | 12/1947 | Wilkinson | 248/188.6 |
| 2,805,906 | 9/1957 | Hoven et al. | 108/129 |
| 3,271,075 | 9/1966 | Good | 108/129 |

*Primary Examiner*—James C. Mitchell
*Attorney, Agent, or Firm*—Brisebois & Kruger

[57] ABSTRACT

A self-locking folding leg arrangement which enables extending the leg and automatically locking the leg when the extended position is reached, enables quickly releasing the leg by withdrawing the leg lock against the action of its spring, assures rigidity by virtue of the cooperation of a flange which limits the extent of extension of the leg, while the lock prevents return movement of the leg toward its folded position, and facilitates unlatching or unlocking the leg for folding by virtue of a finger tab on the lock. The leg and lock are each pivotally mounted on parallel axes closely adjacent to and on the same side of a generally flat plate adapted to be secured to the underside of a horizontal support member such as a work bench top or sawhorse top. The lock is spring biased to fold toward the leg, so the folded assembly is relatively flat and compact, and by pivoting the leg to its extended position, the lock is moved outwardly against the action of its spring, to a position in which it snaps over a cooperating V-shaped element on the leg, to lock the leg against folding.

5 Claims, 6 Drawing Figures

SELF LOCKING FOLDING LEG

FIELD OF THE INVENTION

The invention relates to a self-locking folding leg arrangement particularly useful for sawhorses and portable benches or tables.

BACKGROUND OF THE INVENTION

Structures such as tables, sawhorses, and work benches with folding legs, some of which are self-latching, are known in the prior art. Exemplary of such prior devices, are the folding leg arrangements shows and described in the following U.S. Pat. Nos.: 538,748 Schroder et al, 2,318,945 Johannsen, 2,432,266 Wilkinson.

While the folding leg arrangements of these references are satisfactory for certain purposes, the leg arrangement of Johannsen includes a complex double pivot, the leg of Wilkinson lacks rigidity and tends to pinch the fingers of one attempting to unlatch the leg, and the arrangement of Schroder is both exceedingly heavy and cumbersome and it is difficult to unlatch the leg from its extended position.

SUMMARY OF THE INVENTION

In accordance with this invention, a self-locking folding leg arrangement is provided which enables extending the leg and automatically locking the leg when the extended position is reached, enables quickly releasing the leg by withdrawing the leg lock against the action of its spring, assures rigidity by virtue of the cooperation of a flange which limits the extent of extension of the leg, while the lock prevents return movement of the leg toward its folded position, and facilitates unlatching or unlocking the leg for folding by virtue of a finger tab on the lock.

According to this invention, the leg and lock are each pivotally mounted to a generally flat plate adapted to be secured to the underside of a horizontal support member such as a work bench top or sawhorse top. The axes of pivotal movement of the leg and lock are parallel and are closely adjacent to the plate so that each leg and its latch can be folded inwardly beneath the top. The lock is spring biased to fold toward the leg, so the assembly when folded is relatively flat and compact, and in response to pivoting the leg to its extended position, the lock is moved outwardly against the action of its spring, to a position in which it can snap over a cooperating V-shaped element on the leg, to lock the leg against folding.

The features discussed above provide a foldable leg arrangement, particularly useful in the construction industry, and in which the legs can be extended and folded easily and conveniently, even by a workman wearing gloves.

Correspondingly, an object of the invention is a self-locking leg arrangement with a unique spring biased self-locking lock which pivotally folds with the leg.

An additional object is a leg arrangement according to the preceding object in which a finger on the lock engages under a surface of a cooperating lock element on the leg to rigidly hold the leg in its extended position.

An additional object is a folding leg arrangement in which the lock tends to maintain the leg in its folded position by virtue of the action of its spring.

Numerous other objects and features of the invention will become apparent with reference to the drawings.

DETAILED DESCRIPTION OF PREFERRED EMBODIMENT

The embodiment of the folding leg to be shown and described is illustrated for use with a sawhorse 10 having a top 12 and identical folding leg assemblies 14 and 16 of this invention, secured to the underside of the top. While the top 12 in the preferred embodiment is a length of construction wood such as a 2 × 4 or a 2 × 6, several feet long, it is to be understood that leg assemblies 14 and 16 can be used with other tops such as benches or tables, without departing from the scope of this invention.

Figure 2:
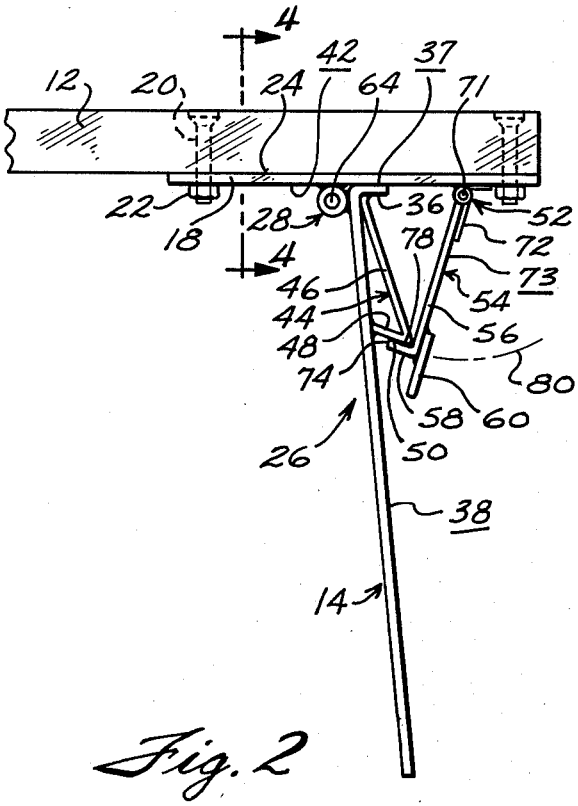
FIG. 2 is an enlarged front elevational view of a self-locking folding leg according to the invention.

As shown at FIG. 2, for leg assembly 14, each leg assembly includes a generally flat rectangular metal plate 18 having spaced openings to permit securing the plate to the underside of top 12 with suitable threaded fasteners such as flat head screws or bolts 20 which extend down through the top. Nuts 22 are threaded on the screws to secure the plate to the top at several spaced locations. The openings in the top 12 through which the screws extend are preferably countersunk so the upper surface of the top 12 is flat and has no projections extending above this surface. Plate 18 has a top surface 24 which is essentially flat to permit the top 12 to seat flat against the plate 18.

Figure 3:
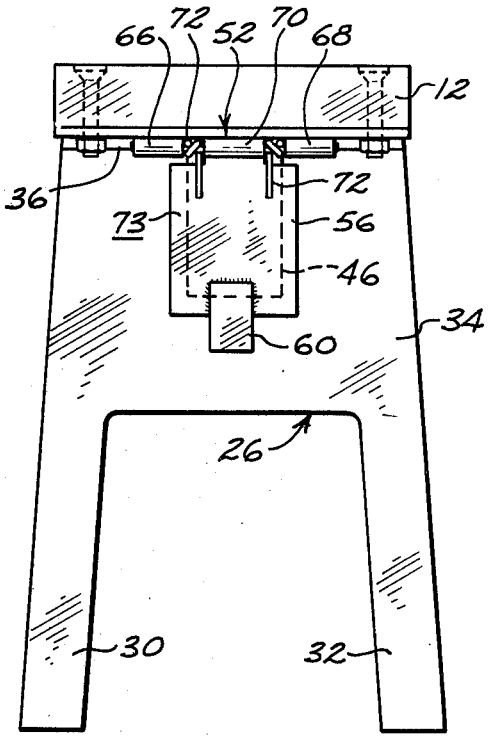
FIG. 3 is an end view of the leg of FIG. 2.

Leg assembly 14 includes a leg unit 26 pivotally connected to plate 18 at a pivot connection 28. The leg unit 26 is formed from metal, and can have integral spaced apart legs 30 and 32 which diverge with respect to each other as shown at FIG. 3. As is apparent from FIGS. 2 and 3, the upper portion of leg unit 25 takes the form of a generally flat plate-like portion 34 coplanar with legs 30 and 32. Pivot connection 28 is offset to one side of the plane of the flat leg unit 26 and is at the inside, as shown at FIG. 2 of the leg unit. A flange 36 at the top of the leg unit projects outwardly of the leg unit in a direction away from the pivot connection 28. This flange 36 can be bent from the material of the leg unit, or can be welded to the upper edge of the leg unit. In either instance, the top surface 37 of flange 36 extends at an acute angle to the outside face 38 of the leg unit so the leg unit, in the extended position shown in FIG. 2, slopes slightly outwardly beyond a vertical position with respect to plate 18. The preferred angle of slope of the leg is 5° to 10° from vertical, and correspondingly, the angle between flange 36 and the plane of leg unit 26 is 80° to 85 °. Flange 36 advantageously extends the width of leg unit 26 and its top surface 37 functions as a stop, which engages the bottom surface 42 of plate 18 to limit the extend of outward pivotal movement of the leg unit.

Secured to the outside face 38 of leg unit 26 is a triangular member 44. This member has a width substantially less than the width of the leg unit, as shown at FIG. 3, and is generally V-shaped, having a flat leg portion 46 which extends downwardly at an acute angle to the plane of leg unit 26, and an end portion 48 which extends at an acute angle to leg portion 46. End portion 48 has a downwardly facing lock surface 50.

Pivotaly connected to plate 18 at a pivot 52 spaced from and parallel with pivot 28 is a lock element 54. Lock element 54 has a body 56 with its upper end connected to pivot 52, and a lock finger 58 projects generally perpendicularly from the lower end of body 56. Secured to body 56 and projecting downwardly beyond lock finger 58 is a tabl 60 which facilitates movement of the lock element outwardly to release leg unit 26. As shown at FIG. 3, the width of body portion 56 of lock element 54 is slightly greater than the width of leg 46 of V-shaped member 44.

Figure 1:
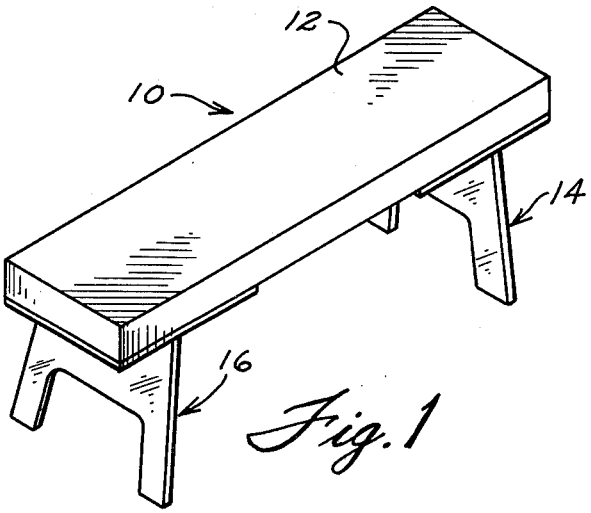
FIG. 1 is a pictorial view of a sawhorse with folding legs in accordance with this invention.
Figure 4:
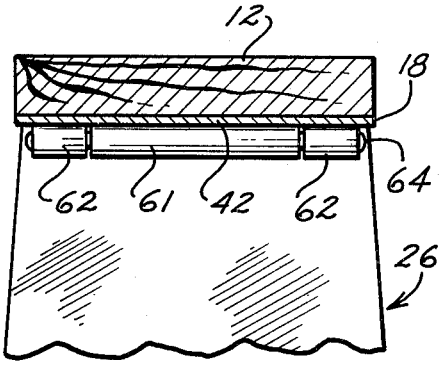
FIG. 4 is a partial view in section taken along line 4—4 of FIG. 2 and showing the hinge connection of the leg.

With reference to FIGS. 2 and 4, pivot connection 28 includes a tube or pipe 61 welded to the bottom surface 42 of plate 18. Pipe 61 is perpendicular to the sides of the plate 18 and is shorter than the width of the plate. Short tubes or pipes 62 of the same diameter as pipe 61, are aligned and welded to the inner surface of leg unit 26, at its upper end. A pivot pin 64 is driven through the openings in the respective pipes 62 and 61 to pivotally connect the leg unit to the plate.

Pivot connection 52 for lock element 54 includes a pair of short pipe sections 66 and 68 welded to the bottom surface 42 of plate 18. The openings in pipe sections 66 and 68 are aligned and these sections are spaced apart to receive between them, a pipe 70 of the same diameter as pipe sections 66 and 68 and which is welded to the upper end of leg 56 of the lock element. The pipe 70 preferably has a length less than the distance between the inner ends of pipe sections 66 and 68 so that a torsion spring 72 can be positioned at each end of pipe section 70 on the pin 71 which extends through pipes 66, 68 and 70. The ends of the torsion spring bear respectively against the bottom surface 42 of plate 18, and the outside surface 73 of lock element 54 to bias the lock element toward the leg unit 26.

Figure 5:
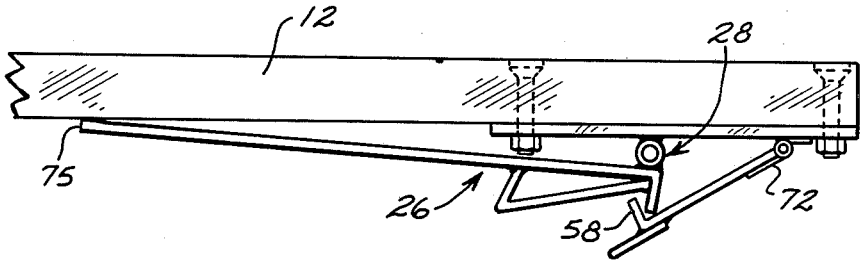
FIG. 5 is a view corresponding to FIG. 2 and showing the leg in its folded position.

FIG. 5 shows the position of the leg unit 26 and lock element 54 when the leg is folded. In this folded position, leg unit 26 is closely adjacent to the bottom surface of top 12, and the edge of foot 75 of the leg unit can engage the surface 42. The lock element 54, by virtue of the action of springs 72, folds toward the leg unit 26 and tends to maintain the leg unit in this folded position.

Figure 6:
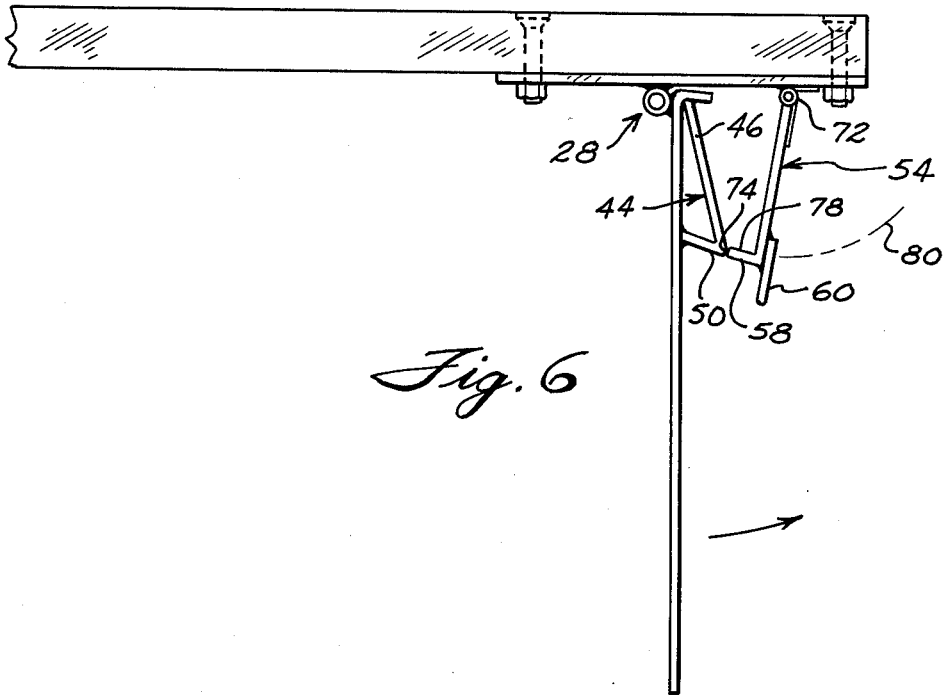
FIG. 6 is a view corresponding to FIG. 2 and showing the position of the leg and lock element immediately before the lock element snaps over the lock surface of the leg to hold the leg in its extended position.

The leg is extended to and simultaneously locked in its extended position by the simple expedient of grasping leg unit 26 and pivoting it outwardly until stop surface 37 of flange 36 abuts or engages the bottom surface of plate 18. In this fully extended position, lock finger 58 of the lock member 54 moves to the position of FIG. 2, under the action of springs 72. In this position, the lock finger 58 extends across lock surface 50 and prevents moving the leg back to its folded position. As the leg is unfolded, the leg 46 of the V-shaped member 44 engages and slides along the tip 74 of lock finger 58 to pivot the lock element 54 outwardly against the action of the springs 72 as the leg is moved towards its extended position. FIG. 6 shows the position of the leg and lock member slightly before the leg reaches its extended position in which the lock finger 58 clears the corner of V-shaped member 44 and the lock element snaps to the locked position shown at FIG. 2. Since the lock element is moved to its locked position by the action of springs 72, it is apparent that each leg unit can be extended by merely moving the leg to its extended position.

To assure that the lock element 54 will securely hold the leg in its extended position, the geometry of the leg assembly and lock element is such that the inside or upper surface 78 of lock finger 58 is tangent to an arc 80 (shown in phantom lines at FIGS. 2 and 6) having the axis of pin 71 at pivot 52 as its center, and a radius equal to the distance from the axis of pin 71 to the surface 78. Lock surface 50 of the V-shaped member 44 is tangent to this arc 80, but only when leg unit 26 is in the fully extended position shown at FIG. 2. By virtue of this geometry, the tip 74 of lock finger 58 will clear the nose of V-shaped member 44, when the leg unit 26 is fully extended, and will snap from its FIG. 6 position to the FIG. 2 locking position. When lock finger 58 is in its locked position of FIG. 2, the finger extends across lock surface 50, and leg unit 26 cannot be pivoted away from its extended position. It will be noticed that the location of pivot 28, which is spaced from pivot 52, requires that lock surface 50 pivot downwardly directly away from pivot 52 when the leg unit 26 moves initially from its extended position toward its folded position. By virtue of the geometry of lock finger 58 with respect to pivot 52, the pull exerted on the lock element is radial with respect to the pivot, and hence, there are no forces created which tend to move the lock element 54 away from the leg.

To fold the leg to the folded position of FIG. 5, it is merely necessary to grasp tab 60, and pull the lock member outwardly away from the leg. As lock finger 58 clears lock surface 50, the leg can be pivoted to the FIG. 5 position, and release of the lock member causes the lock member to swing inwardly to the FIG. 5 position. By virtue of the action of spring 72, the lock member assists retaining leg unit 26 in the folded position of FIG. 5.

By virtue of the outward slope of leg unit 26 with respect to plate 18, when the leg is extended, there is normally no tendancy for the leg to pivot inwardly toward its folded position so long as there is only a downward force on top 12. However, in the event that longitudinal forces act on the top, the lock element 54 positively prevents the leg from folding inwardly.

Correspondingly, in accordance with this invention, there is provided a self-locking leg which automatically locks in its extended position, is easy to unlock intentionally, even by a workman wearing gloves, but is quite resistant to accidental unlatching, so that the leg, once extended and locked, provides a reliable and firm support.

While a preferred embodiment has been shown and described, numerous changes can be made without departing from the scope of this invention as defined in the appended claims.

What is claimed is:

1. A self-locking folding leg comprising a leg;

a flat support plate;

means pivotally connecting said leg to said support plate for pivotal movement about a first axis to a folded position closely adjacent the support plate, and to an extended position generally perpendicular to the support plate;

stop means at the upper end of said leg engageable with a surface of the support plate to limit the extent of pivotal movement of the leg to said extended position; and lock means for locking the leg in said extended position against pivotal movement to said folded position, said lock means comprising a generally V-shaped element on said leg presenting a lock surface facing away from said support plate and at an acute angle to the plane of the leg, a lock element on the same side of the leg as said stop means and lock surface, and pivot means pivotally connecting said lock element to said support plate for pivotal movement about a second axis on the same side of the plate as the first axis, and in a common plane generally parallel to the plate and including the first axis;

said lock element comprising a body connected to said pivot means, a lock finger on said body and spaced from said pivot means, said lock finger extending across said lock surface and engaging the lock surface to prevent pivotal movement of the leg to said folded position, and spring means continually urging said lock element toward said leg, said spring means maintaining said lock finger extending across said lock surface, and means on said lock element to facilitate manually moving said lock finger away from said lock surface and leg against the action of said spring to release the leg for movement to said folded position adjacent the support plate, said spring means urging said lock element toward said leg so that the lock element folds toward said support plate when said leg is folded.

2. A folding leg according to claim 1 wherein said spring means is a torsion spring between said support plate and said body of the lock element at said pivot means for the lock element.

3. A self-locking leg according to claim 1 wherein said pivot means pivotally connects said leg to said support plate at a location offset to one side of the plane of the leg; and said stop means comprises a flange projecting away from said pivot and at an acute angle to said leg, said flange engaging said support plate, in the extended position of the leg to prevent pivotal movement of the leg beyond the extended position.

4. A self-locking leg according to claim 1 wherein said lock finger comprises a flat surface generally tangent to an arc having the axis of said pivot means as its center; and said leg, when locked by said lock element, having its lock surface generally tangent to said circle.

5. A folding leg according to claim 1 wherein said leg, in said extended position, sloping outwardly of said support plate, said stop means limiting the extent of such sloping.

* * * * *